United States Patent [19]

Corfa et al.

[11] 4,280,288

[45] Jul. 28, 1981

[54] MODULAR DRAGING UNIT FOR COLLECTING SOLID BODIES ON AN UNDERWATER BED

[75] Inventors: Yves-Paul Corfa, Nantes; Paul Marchal, Gif-sur-Yvette; Victor Roussel, Maintenon; Jean Vertut, Issy les Moulineaux, all of France

[73] Assignee: Commissariat a l'Energie Atomique, Paris, France

[21] Appl. No.: 157,846

[22] Filed: Jun. 9, 1980

Related U.S. Application Data

[63] Continuation-in-part of Ser. No. 945,105, Sep. 25, 1978, abandoned.

[51] Int. Cl.[3] ..... E21C 45/00; E02F 9/00

[52] U.S. Cl. ..... 37/54; 37/56; 37/71; 37/DIG. 8

[58] Field of Search ..... 37/54, 58, DIG. 8, 195, 37/55, 56, 71

[56] References Cited

U.S. PATENT DOCUMENTS

| | | | |
|---|---|---|---|
| 3,226,854 | 1/1966 | Mero | 37/DIG. 8 |
| 3,314,174 | 4/1967 | Haggard | 37/DIG. 8 |
| 3,672,725 | 6/1972 | Johnson | 37/DIG. 8 |
| 3,748,248 | 7/1973 | Wanzenberg et al. | 37/DIG. 8 |
| 3,812,922 | 5/1974 | Stechler | 37/DIG. 8 |
| 3,999,313 | 12/1976 | Andrews | 37/DIG. 8 |
| 4,010,560 | 3/1977 | Diggs | 37/DIG. 8 |
| 4,035,022 | 7/1977 | Hahlbrock et al. | 37/DIG. 8 |
| 4,037,874 | 7/1977 | Willums | 37/DIG. 8 |
| 4,053,181 | 10/1977 | Saito | 37/DIG. 8 |
| 4,147,390 | 4/1979 | Deliege et al. | 37/DIG. 8 |

FOREIGN PATENT DOCUMENTS

| | | | |
|---|---|---|---|
| 2313547 | 12/1976 | France | 37/DIG. 8 |
| 2370164 | 6/1978 | France | 37/DIG. 8 |

*Primary Examiner*—Clifford D. Crowder

*Attorney, Agent, or Firm*—Kerkam, Stowell, Kondracki & Clarke

[57] ABSTRACT

A modular draging unit for collecting solid bodies such as polymetallic nodules on an underwater bed such as a sea floor comprises a plurality of collecting structures and a storage structure which are intended to be applied against the sea floor, means for displacing these structures along the sea floor, for collecting nodules and for transferring the nodules into the storage structure. The collecting structures are located side by side at a front edge of the unit and each collecting structure is coupled to the storage structure by means of at least one link-arm in such a manner as to permit of relative motion with at least two degrees of freedom and to maintain each collecting means in a predetermined position with respect to the sea floor during a nodule-collecting operation.

15 Claims, 11 Drawing Figures

MODULAR DRAGING UNIT FOR COLLECTING SOLID BODIES ON AN UNDERWATER BED

REFERENCE TO RELATED APPLICATION

This application is a continuation-in-part of application Ser. No. 945,105 filed Sept. 25, 1978 and now abandoned.

This invention relates to a modular dragging unit for collecting solid bodies on an underwater bed, a primary application of the device being the collection of polymetallic nodules on a sea floor.

In response to the economic attention focused on the potential mineral resource offered by nodule deposits, many types of equipement have been developed for extracting nodules from sedimentary material on a sea floor which can lie at a considerable depth below the surface of the sea.

Thus, the different dragging unit which are already known travel along the bottom and are equipped with means for collecting and storing nodules. Units of this type can either be operated from the surface by means of cables which draw them along the sea bed or alternatively, they can be equipped with means which permit independent displacement along said sea bed.

Some nodule-collecting units which have their own source of energy can also be designed not only to collect nodules but also to raise them to the surface.

However, the units of the above-mentioned type which were designed prior to the present invention are subject to a disadvantage in that they do not make it possible to obtain a sufficiently high nodule-collection yield in respect of a given swept surface area of the sea floor.

In fact, these units are so designed that the efficiency of their collecting means decreases when their specific weight in water increases, especially as a result of storage of the nodules.

A further drawback attached to collecting and storing units lies in the fact that they do not permit of satisfactory separation of the nodules from the supporting sediment.

The precise aim of the present invention is to provide a draging unit which serves to collect solid bodies on an underwater bed and makes it possible to overcome the disadvantages mentioned above.

This dragging unit essentially comprises:

a plurality of collecting structures for individually collecting said solid bodies, said structures being applied against said underwater bed and located side by side at a front edge of said dragging unit, a storage structure for storing said bodies as they are collected, said structure being applied against said underwater bed, means for displacing said collecting and storage structures along said bed in a given direction, said means being rigidly fixed to the storage structure, a plurality of means for collecting said bodies along said given direction, each said means being rigidly fixed to one of said collecting structures, and, a plurality of means for transferring said bodies as they are collected from each collecting means into said storage structure along said given direction, each said transferring means being rigidly fixed to one of said collecting structures, wherein coupling means are provided between each collecting structure and the storage structure, said coupling means permitting an independent relative movement of each collecting structure with respect to the storage structure and maintaining each collecting structure in a predetermined distance and orientation with respect to said underwater bed at the time of collection of said bodies whatever the position of said storage structure relative to said bed and whatever the variations in profile of the underwater bed, each coupling means between one of said collecting structures and the storage structure comprising at least one link-arm connected to each structure to provide at least two degrees of freedom between said structures.

One of the chief advantages of the unit as defined in the foregoing lies in the fact that it serves to maintain preferential positioning of the collecting means with respect to the sea floor at the time of extraction of bodies such as nodules. In fact, the unit is so designed that its collecting means are advantageously carried by a plurality of side by side individual structures, each of said structures having a substantially constant specific weight at the time of extraction of nodules and being capable of following the variations in profile of the sea floor in a suitable manner. In more exact terms, the collecting structures are capable of following variations in profile of the sea bed at least in pitching motion, rolling motion, ramming and lateral drift.

Moreover, each collecting structure is preferably supported on the sea bed by means of a bearing surface having two portions located respectively upstream and downstream of said collecting means according to the direction of displacement of the dragging unit, the front end of each portion aforesaid being provided with a convex curvature with respect to said sea bed.

In accordance with an advantageous feature of the invention, the collecting means comprise a plurality of extraction blades parallel to the direction of displacement, said extraction blades being pivotally mounted on a shaft located at right angles to said blades, means for positioning the extraction blades and defining the work position of the extraction blades with respect to said sea bed, at least one flexible-blade wheel for impelling the extracted bodies, said wheel being mounted above said extraction blades on a shaft which is substantially parallel to the extraction-blade shaft and means for driving said wheel in rotation.

The advantage of the distinctive feature thus mentioned lies in the fact that maximum separation from the sea-bed material is achieved when collecting solid bodies such as nodules.

In accordance with this distinctive feature, the upstream and downstream portions of the bearing surface of the collecting structure are so dimensioned that the pivotal axis of the extraction blades remains in a substantially constant relative position with respect to the sea bed irrespective of the variations in profile of the bed and in the quantity of nodules which are present in the transfer means.

Furthermore, the dragging unit in accordance with the invention can advantageously be provided in addition with means for measuring variations in slope of the sea bed between two zones located respectively upstream and downstream of the collecting means and means which are actuated by said measuring means and serve to control the means for positioning the extraction blades.

In accordance with another advantageous feature which is provided for ensuring operational safety, the aforesaid means for positioning the extraction blades are preferably capable of permitting withdrawal of the extraction blades when a force exceeding a predetermined threshold value is applied to the blade tips, then of restoring said extraction blades to the work positions thereof when said force is below said threshold value. Moreover, the blade-positioning means can advantageously be associated with means for defining a limiting position of blade withdrawal so that each extraction blade in this position constitutes a bearing member which supports the collecting structure on said sea bed.

It is thus possible to forestall any potential danger of jamming and fracture of the extraction blades on an obstacle and to assist the passage of the collecting structure over this latter.

In accordance with yet another distinctive feature of the invention, the means for transferring solid bodies comprise a unit for discharging collected bodies into said storage structure, said unit being pivotally mounted on said collecting structure, at least one conveyor for bringing the collected bodies into the discharging unit and means for guiding and driving said conveyor.

In accordance with the invention, the flexible-blade wheel and the conveyor can be driven either by motors or from at least one unit which is rigidly fixed to said collecting structure in such a manner as to be applied against said sea bed and to be set in motion by reaction on the bed at the time of propulsion of the structures.

In accordance with the invention, the means for propelling said structures can be constituted by a cable secured at each end respectively to the storage structure and to a surface vehicle or by a cable or link-arm for coupling the storage structure to the body of an underwater vehicle as described in French patent Application No. 77 01287 filed on Jan. 18, 1977 in the name of the present Applicant. These propulsion means can also be constituted by units for carrying the storage structure, said units being capable of setting said structure in motion by reaction on said sea bed.

Each collecting structure of the dragging unit in accordance with the invention can constitute one of the dredges of the nodule-collecting vehicle as described in French patent Application No. 77 01288 filed on Jan. 18, 1977 in the name of the present Applicant.

Further distinctive features and advantages of the present invention will become more readily apparent from the following description of a preferentially embodiment of the device in accordance with the invention for collecting nodules on a sea floor.

This description will be given with reference to the accompanying drawings, in which.

Figure 2:
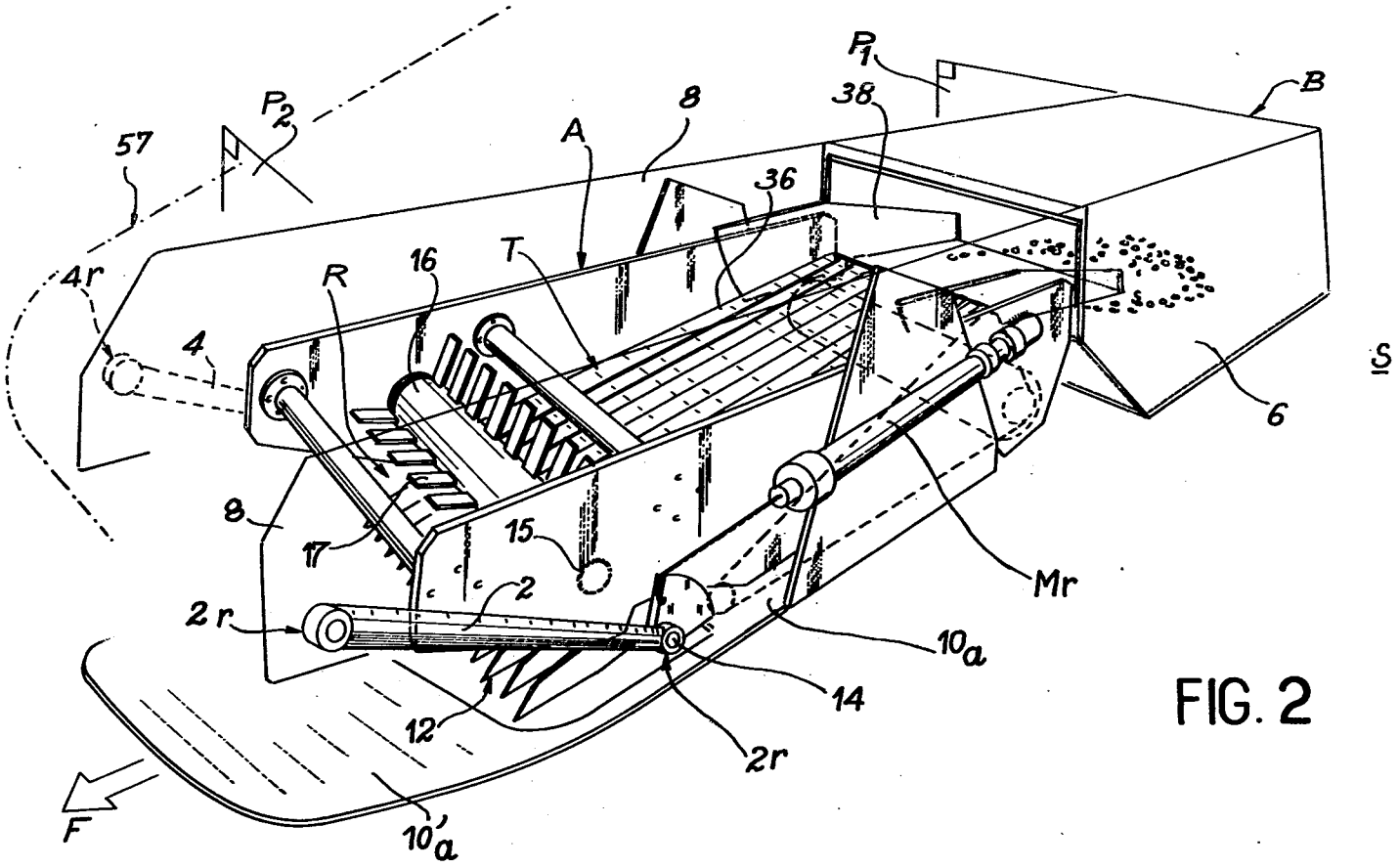
FIG. 2 is a view in perspective showing one of the collecting devices of the dragging unit shown in FIG. 1.

FIGS. *6a* and *6b* are views in elevation showing the mode of operation of the device of FIG. 2;

FIGS. *7a* and *7b* show alternative forms of construction of the collecting device of FIG. 2.

Figure 8:
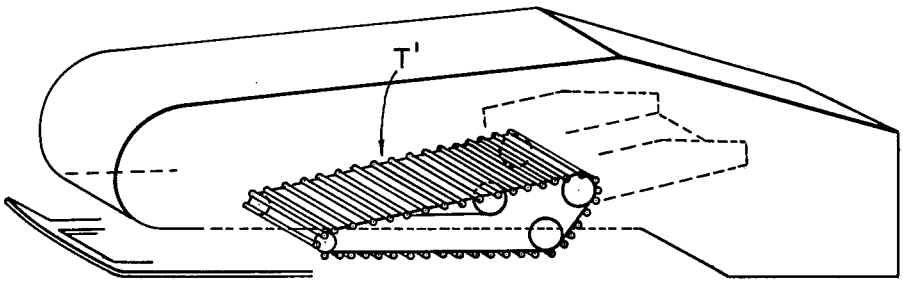

FIG. 8 shows a flight conveyor used in the module; and

Figure 9:
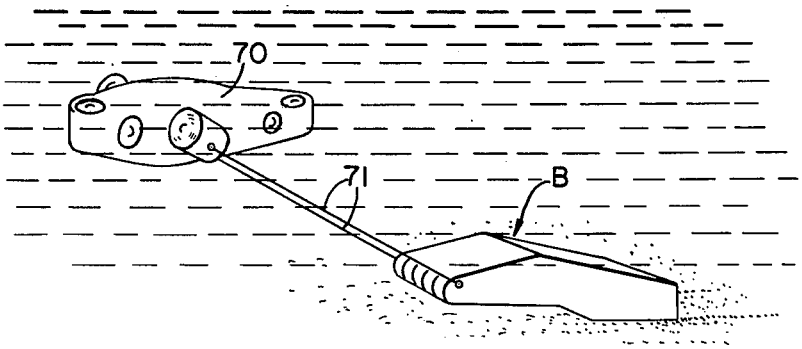

FIG. 9 shows the module moved by an underwater vehicle.

Figure 1:
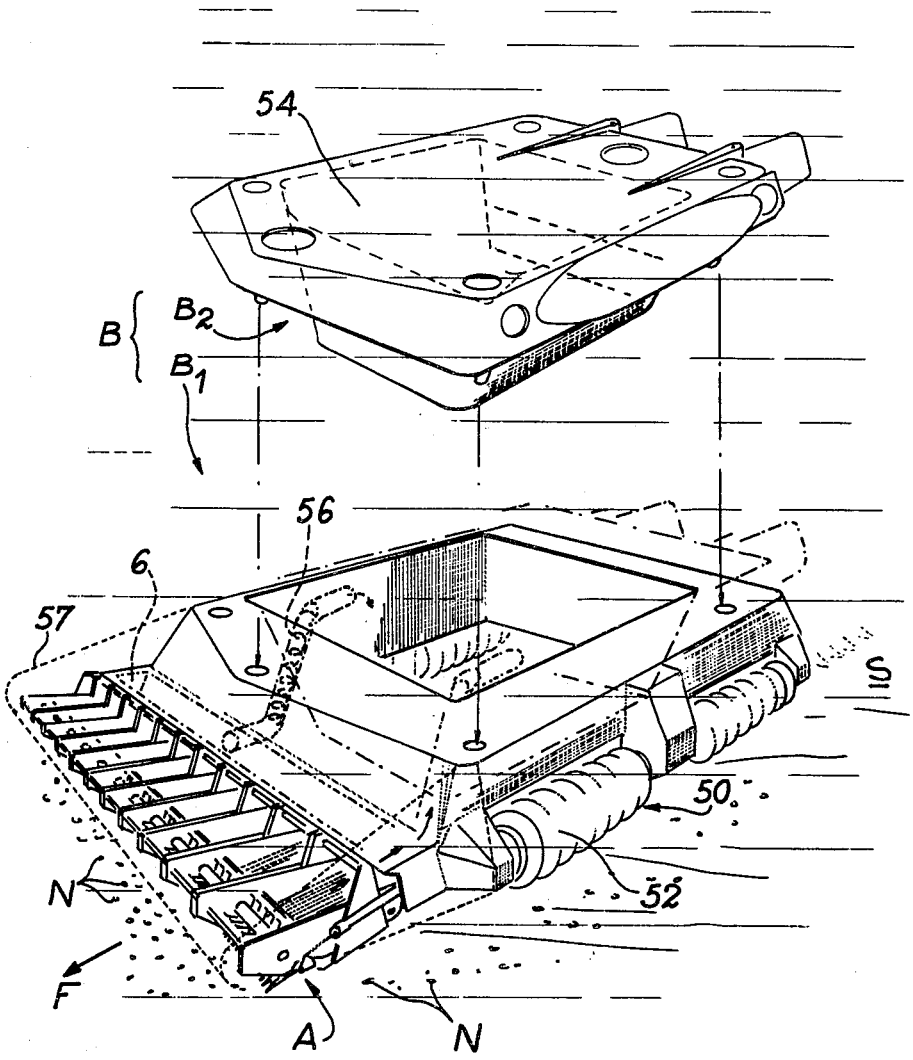
FIG. 1 is a general view in perspective showing a preferred embodiment of the nodular dragging unit according to the invention.

In FIG. 1, there is shown in perspective a modular dragging unit in accordance with the invention for collecting polymetallic nodules N on a sea floor as it travels along the sea-floor surface S.

The dragging unit in accordace with the invention is essentially constituted by a plurality of collecting structures A and a high capacity main storage structure B, said structures having the respective functions of collection of nodules on the sea-floor surface S and of storage of these latter.

The storage structure B is so designated as to carry out displacement of the dragging unit and upward transfer of collected nodules to the surface.

Thus, the storage structure B is equipped with means both for supporting and propelling it along the surface S of the sea floor. In FIG. 1, the references 50 designate units which are rigidly fixed to a helical propulsion fin 52. These units 50 are intended to support the structure B on the sea floor S by means of their external walls and to effect the propulsion of the structure B in the forward direction of the arrow F once they have been driven in rotation. The collecting structures A are located side by side at a front edge of the draging unit with reference to said forward direction F.

Furthermore, the structure B is constituted by two separable modules $B_1$ and $B_2$ which are shown separately in FIG. 1, the upper module $B_2$ being intended to permit upward transfer of collected nodules to the surface of the sea.

To this end, the module $B_2$ has its own source of energy, a suitable ballast capacity at a set of propulsion units for underwater operation of the module.

It will further be noted that the module $B_2$ is provided with a main storage bin 54 into which the nodules are transferred. After being collected by each structure A, the nodules are first transferred, as explained later, into an intermediate buffer storage space 6 provided at the front end of the structure B.

In FIG. 1, the reference numeral 56 designates screw conveyors which are intended to transfer the nodules in the upward direction from the buffer storage space 6 into the storage bin 54.

There is also shown in dashed lines in FIG. 1 a hood 57 of the structure B which serves to protect the collecting structures A against external shocks, especially when they are raised to the surface, and which reduces hydrodynamic drag of the draging unit as a whole.

As shown in FIG. 2, assuming that the dragging unit is travelling in the forward direction of the arrow F, each collecting structure A comprises from the front end to the rear end a nodule-collecting unit R and a unit T for transferring collected nodules into the intermediate buffer storage space 6.

In accordance with the essential feature of the invention, each collecting structure A is individually coupled to the storage structure B in order that the collecting unit R can be maintained in a predetermined positio with respect to the sea-floor surface S at the time of collection of nodules.

Figure 3:
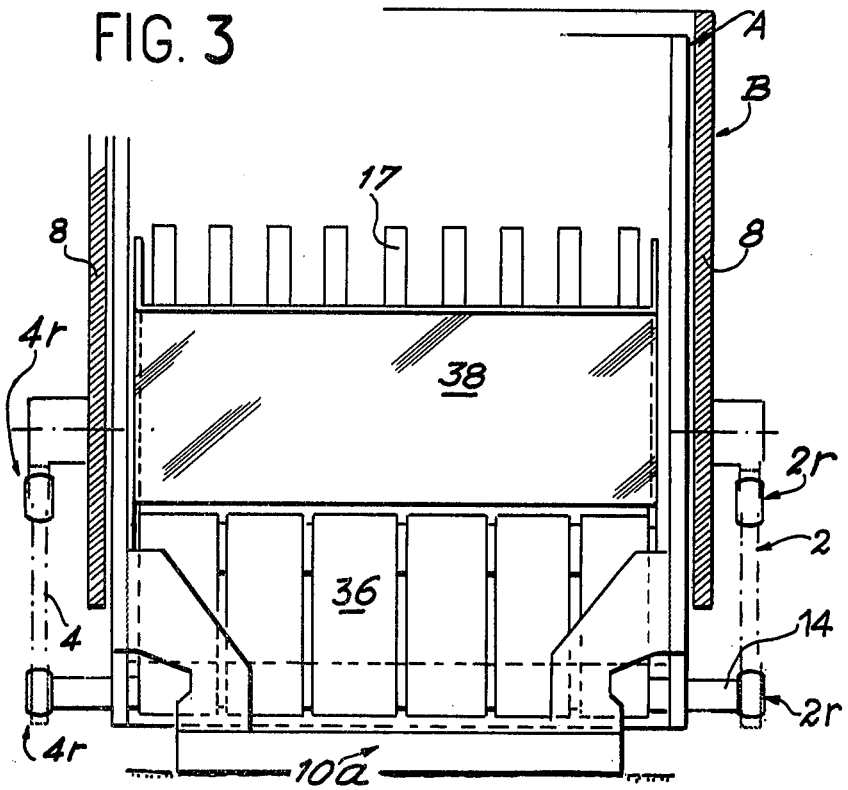
FIG. 3 is a rear view of the device of FIG. 2, this view being taken along the plane $P_1$ of FIG. 2.

It is thus apparent from FIGS. 2 and 3 that each structure is coupled to the structure B by means of link-arms 2 and 4 each pivotally mounted by means of swivelbearing systems *2r* and *4r* on the one hand on each side of the collecting unit R and on the other hand on the hood 57 of the structure B at the front end of this latter.

It can already be noted that the respective bodies of the structure A and B are constituted by open structures having a suitable specific weight in water. Said structures are fabricated from lightweight materials and equipped if necessary with means of a type known per se for fixing their specific weights such as, for example, a container or a composite material of known type.

It can be seen in FIGS. 2 and 3 that the storage structure B comprises a plurality of longitudinal members 8 (only a pair of said members being shown in the figures) each collecting structure A being located between a pair of said members in front of the intermediate buffer storage space 6. Each collecting structure A is supported on the sea floor S by bearing surfaces or pads 10*a*, 10*a'*, these surfaces having front edges defining a convex curvature with respect to the underwater bed, whereby a convex area is always applied against the sea-bottom terrain. Thus a reduction in supporting capacity of the sea bed is compensated by an increase in the bearing area.

As shown in FIG. 2, the collecting unit R of each structure A comprises a plurality of extraction blades 12 parallel to the forward direction F, said blades being mounted at right angles on a pivotal shaft 14 associated with means $M_R$ for positioning the extraction blades 12 with respect to the sea floor S and permitting the withdrawal of the blades whenever these latter encounter an obstacle. The collecting unit R also comprises a blade-wheel 16 which is intended to provide mechanical assistance for the collection of nodules. Said blade-wheel is mounted above the extraction blades 12 on a shaft 15 which is substantially parallel to the shaft 14 and associated with means (not shown in ths figure) for driving the blade-wheel in rotation. The wheel 16 is equipped with flexible blades 17 which are capable of engaging the nodules after these latter have been dislodged from the sea bed S by the extraction blades 12 and of thrusting them towards the transfer unit T. It should be noted that, taking into account its curved shape, the pad 10'A also constitutes the equivalent of a bumper or fender for protecting the wheel 16 and its flexible blades 17 from obstacles which may be encountered in the sea bed.

It will be noted that the two bearing surfaces 10'*a* and 10*a* of each structure A are located respectively upstream and downstream of said collecting unit R in order to prevent clogging or sticking of this latter in the sediment at the time of a variation in profile of the sea floor S. The dimensions of these bearing surfaces 10*a* and 10'*a* are such that, at the time of variations in profile of the sea floor S and in the quantity of nodules which are present in the transfer unit T, the shaft 14 remains substantially in the same relative position with respect to the sea floor S.

Figure 5:
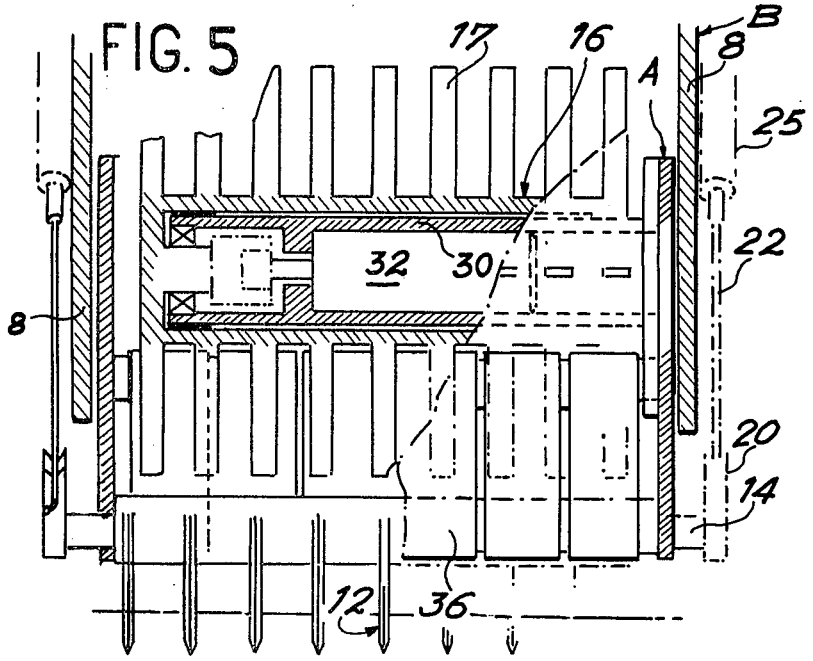
FIG. 5 is a front view of the device of FIG. 2, this view being taken along the plane $P_2$ of FIG. 2.
Figure 4:
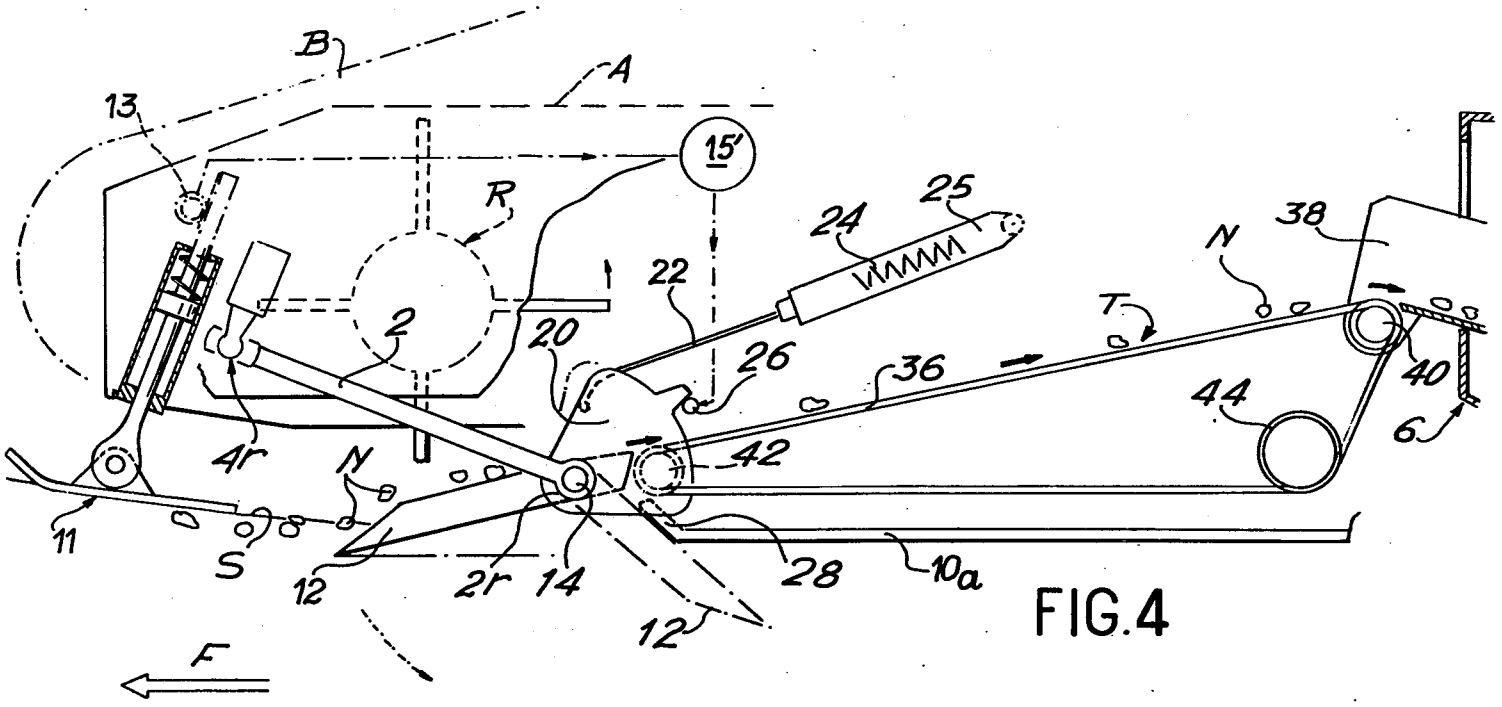
FIG. 4 is a partial side view of the front end of the device of FIG. 2.

In FIGS. 4 and 5, in which the components of the collecting structure already shown in FIGS. 2 and 3 are designated by the same references and in which the surface 10'*a* has been omitted for the sake of enhanced clarity, the aforesaid means $M_R$ associated with the pivotal shaft 14 of the extraction blades 12 are shown in greater detail.

FIGS. 4 and 5 accordingly show that each end of the shaft 14 is rigidly fixed to a grooved sector 20 for a cable 22 which is secured to the end of a spring 24 housed within a casing 25. Said spring works in tension in order to bring said sector 20 into position against a stop 26 which defines the working angle of the extraction blades 12 with respect to the sea-floor surface S or so-called work position in which said extraction blades 12 are buried in the sea bed S at a suitable angle and the edges of which are located beneath the nodules N to be extracted.

It should be noted that a suitable adjustement of the position of the shaft 14 with respect to the bearing surface 10*a* can be associated with the means $M_R$.

Also worthy of mention is the fact that the spring 24 is calibrated in such a manner as to ensure that the extraction blades 12 are caused to retract to a limiting position of withdrawal defined by a stop 28 (FIG. 4) in respect of a predetermined value of resistance of the sea floor at the tips of the blades 12. Said stop 28 is so designed that the retracted extraction blades 12 form part of the bearing surface of the structure A which is applied on the sea floor S and prevent failure of the blades when these latter encounter a hard obstacle.

Furthermore, the positioning of the stop 26 can be adjusted by means of a feeler 11 (FIG. 4) as a function of variations in profile of the sea bottom upstream of each structure A, a feeler transducer 13 being intended to actuate a unit 15 for controlling the positioning of the stop 26. It is noted that the feeler 11, which is carried by each structure A, could be replaced by any detector which is responsive to the characteristics of the sea floor upstream of this structure.

Another point worthy of note is the fact that the extraction blades 12 are mounted on the shaft 14 with a relative spacing which is slightly smaller than the size of the polymetallic nodules N. Said extraction blades can be of various shapes such as prismatic, conical or pyramidal whilst the blade profile and material are such as to ensure minimum resistance to penetration into the sea bed S. It should be added that provision can be made for injection of water at the blade tips in order to ensure necessary lubrication with respect to certain salts which have a strongly adherent character.

In FIG. 5, there is also shown diagrammatically the method adopted for driving around its shaft 15, the blade-wheel 16 of each structure A.

Thus it can be seen in this figure that the shaft 15, which is substantially parallel to the sea-floor surface and mounted at right angle to the forward direction F in the same manner as the shaft 14, is constituted by a sleeve 30 which is rigidly fixed to the body of the collecting structure A, the wheel 16 being driven in rotation by a reduction-gear motor set 32 which is housed within the interior of said sleeve 30.

In the case in which the specific weight is adjusted by means of composite materials fixed on the vertical flanks of the structure A, it is possible not to place the reduction-gear motor sets 32 within the sleeve 30 but to place these latter within the composite structure, these means being employed to drive the shaft 16.

It is apparent from FIGS. 2 and 4 that the transfer unit T of each collecting structure A, is essentially made up of a belt conveyor 36 and a discharge chute 38 which is pivotally mounted on this structure A. The belt conveyor 36 is constituted by a set of belts carried by guide rollers or idler 40 and 42 and by a driving roller 44. The rollers are positioned in such a manner as to ensure that the collected nodules can be carried to a height and a distance from their point of collection which are sufficient to discharge them into the intermediate buffer storage space 6. It is noted in FIGS. 2 and 4 that the discharged chute 38 is pivotally mounted on the shaft of the guide roller 40 of the belt conveyor 36 and applied against the structure B within the storage space 6. This permits a variation in the angle of tilt of the discharge chute 38 with respect to the structure A at the time of penetration of the structure B into the sea bed S when the storage bin 6 is being filled with nodules. The set of belts 36 which forms the conveyor can be replaced by a flight cnveyor T' (FIG. 8) which is well known to anyone versed in the art. It can be recalled briefly that a flight conveyor of this type consists of two driving side chains mounted on the driving rollers and of flights located at right angles to the direction of motion of the conveyor, the ends of the flights being attached to the chains. Said flights are at right angles to bars which are rigidly fixed to the structure. This form of construction is illustrated in FIG. 8 and, the substitution of this type of conveyor for the belt conveyor 36 shown in FIGS. 2 and 4 will appear evident to anyone versed in the art. Furthermore, an arrangement of this type makes it possible to ensure a certain calibration of bodies to be collected prior to transfer to the storage means.

It should be mentioned that the conveyor belt 36, which has a smooth carrying surface in this example of construction, could be so designed as to pass beneath the bearing surface 10*a* in such a manner as to increase the relative velocity of this latter with respect to the sea floor S and to entrain water with a view to reducing friction.

Figure 6A:
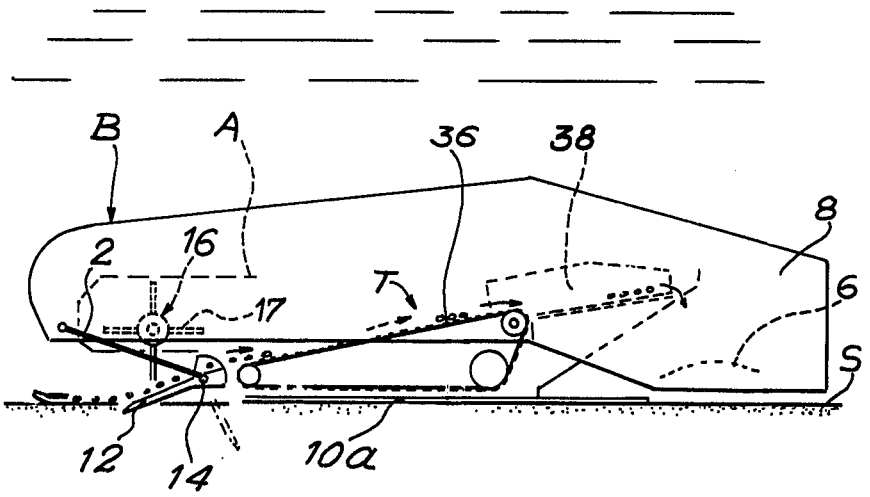
Figure 6B:
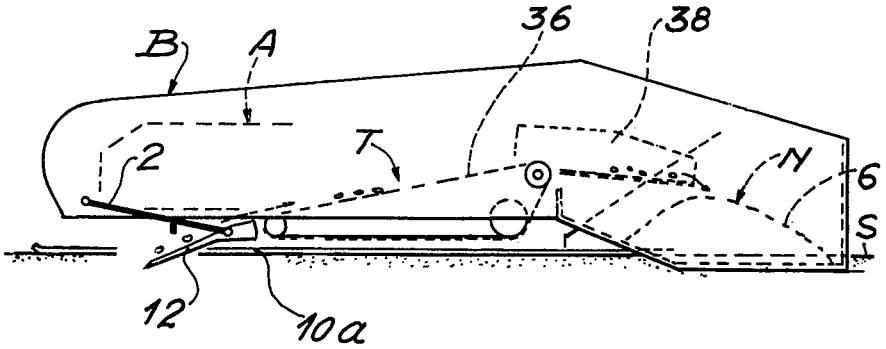

The principle of operation of the modular dragging unit in accordance with the invention will be described herein-after with reference to FIGS. 1, 4, 6*a* and 6*b*. FIGS. 6*a* and 6*b* show diagrammatically the configuration of one of the collecting structures A with respect to the storage structure respectively at the beginning and during extraction of nodules from the sea floor S. In other words, FIG. 6*a* shows the relative arrangement between one of the structures A and structure B when storage space 6 and storage bin 54 are empty and FIG. 6*b* shows this arrangement when the storage bin 54 contains a certain weight of nodules.

At the time of extraction of nodules by displacement of the structures A and B over the sea floor S, the structures A which ensure collection of nodules are subjected only to tractive forces which are substantially parallel to the floor by virtue of the fact that these structures A are coupled to the structure B by means of the link-arms 2 and 4 whilst the specific weight of each collecting structure is pratically not subject to any variation.

Preferably, the specific weight of each structure A is fixed at a value such that the pressure on the sea bed at any point of its bearing surfaces 10'*a* and 10*a* is lower than the maximum supporting capacity of the sea bed.

It is recalled that each collecting structure A is in any case capable of following the variations in profile of the sea floor S, not only in pitching motion but also in rolling motion, ramming and lateral drift within the limits set by the structure B.

Thus it is apparent from FIG. 4 that, thanks to the coupling of each structure A to the structure B by means of the link-arms 2 and 4, the means $M_R$ (20,22,24, 25, 26) which are controlled by the feeler 11 make it possible to obtain in each individual collecting structure A a given angle of penetration of the extraction blades 12 into the sea bed S during a collecting operation, this being achieved independently for each structure A irrespective of the degree of penetration of the structure B into said sea bed and of the differences of the level of the sea floor between the storage structures A.

A satisfactory result is therefore achieved at the time of displacement of the dragging unit along the sea-floor surface S in that the nodules are lifted and separated from the sediment by the extraction blades 12, propelled towards the rear by the flexible blades 17 of the blade wheel 16, then engaged by the belt conveyor 36 and thus directed into the intermediate storage space 6 of the structure B. Finally, the nodules N are transferred to the main storage bin 54 by the screw conveyors 56.

Moreover, it can be seen from FIG. 4 that, when the extraction blades 12 encounter an element which is either too heavy or too deeply embedded in the sea floor S, these blades are in that case subjected to a torque which causes them to withdraw to the stop 28 in opposition to the resistance of the spring 24. After withdrawal, the extraction blades 12 are thus supported and permit lifting of the corresponding structure A as this latter passes over said obstacle without any attendant danger of blade failure.

A further noteworthy advantage is that sticking of the extraction blades 12 in the sediment at the time of a variation in profile of the sea floor is prevented by means of the feeler 11 and/or the bearing surface 10'*a* upstream of the blades.

Figure 7A:
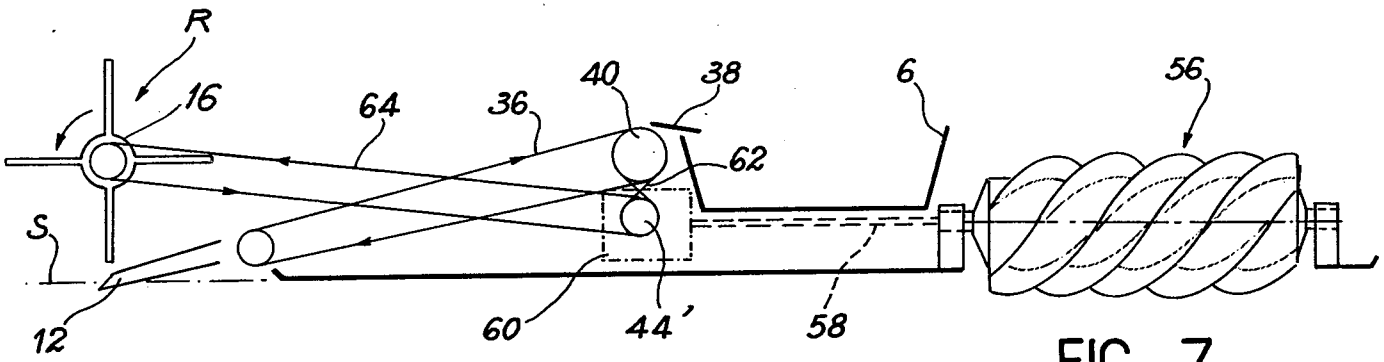
Figure 7B:
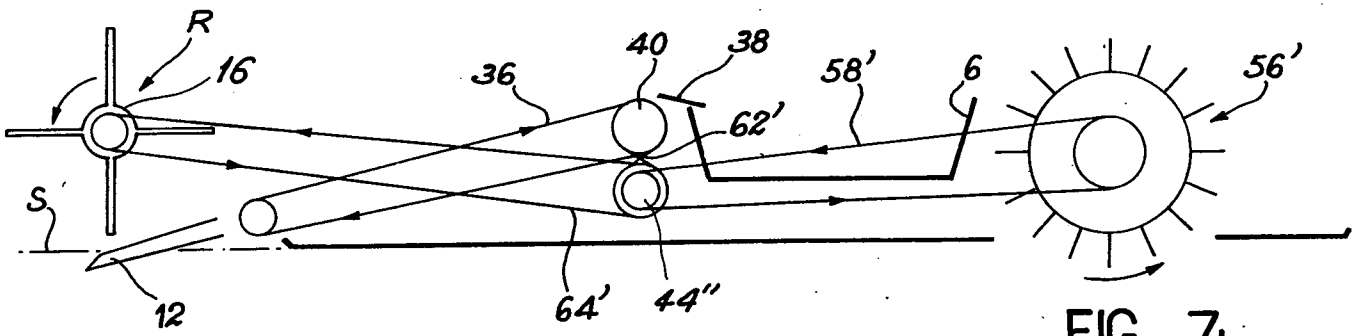

In FIGS. 7*a* and 7*b*, there are shown two forms of construction of the mechanism employed for driving the flexible-blade wheel 16 and the belt conveyor 36.

In these alternative embodiments, driving of the blade-wheel 16 and of the belt conveyor 36 is performed by means of elements which are set in motion by reaction on the sea floor at the time of displacement of the corresponding structure A.

Thus in the alternative embodiment of FIG. 7*a*, the collecting structure A comprises at least one endless screw or auger 56 which engages in the sea bed S in such a manner as to be driven in rotation at the time of displacement of the structure. Thus the flexible-blade wheel 16 and the belt conveyor 36 are driven in rotation from said auger by means of a shaft 58, a motion converter 60, the pulley 44' and belts 62 and 64.

In the alternative embodiment of FIG. 7*b*, each structure A comprises at least one blade-wheel 56' which engages in the sea bed S and is intended to drive the flexible-blade wheel 16 and conveyor belt 36 in rotation by means of a belt 58', the pulley 44'' and belts 62' and 64'.

FIG. 9 shows the previously mentioned underwater vehicle for towing the storage structure where 70 is the underwater vehicle connected by cables 71 to the modular dragging Unit B.

What we claim is:

1. A modular dragging unit for collecting solid bodies on an underwater bed, said dragging unit comprising a plurality of collecting structures for individually collecting said solid bodies, said structures being applied against said underwater bed and located side by side at a front edge of said dragging unit, a storage structure for storing said bodies as they are collected, said structure being applied against said underwater bed, means for displacing said collecting and storage structures along said bed in a given direction, said means being connected to the storage structure, a plurality of means for collecting said bodies along said given direction, each said means being rigidly fixed to one of said collecting structures, and a plurality of means for transferring said bodies as they are collected from each collecting means into said storage structure along said given direction, each said transferring means being rigidly fixed to one of said collecting structures, wherein coupling means are provided between each collecting structure and the storage structure, said coupling means permitting an independent relative movement of each collecting structure with respect to the storage structure and maintaining each collecting structure in a predetermined distance and orientation with respect to said underwater bed at the time of collection of said bodies whatever the position of said storage structure relative to said bed and whatever the variations in profile of the underwater bed, each coupling means between one of said collecting structures and the storage structure comprising at least one link-arm connected to each structure to provide at least two degrees of freedom between said structures.

2. A unit according to claim 1, wherein each collecting structure is supported on said underwater bed by a bearing surface defining two separate bearing portions said portions being located respectively upstream and downstream of the corresponding collecting means along said given direction, a front end of each of said portions having a convex curvature with respect to said underwater bed.

3. A unit according to claim 2, wherein each collecting means comprises a plurality of parallel extraction blades pivotally mounted on an axis at right angles to said blades, tips for said blades, means for positioning said extraction blades and defining a work position for said extraction blades with respect to said underwater bed, at least one flexible-blade wheel mounted above said extraction blades on a shaft which is substantially parallel to the axis of pivotal motion of said extraction blades, and means for rotating said wheel.

4. A unit according to claim 3, wherein said portions of said bearing surface of each collecting structure are so dimensioned that said axis of pivotal motion of said extraction blades is maintained in a substantially constant relative position with respect to said underwater bed during use.

5. A unit according to claim 4, wherein said means for rotating said flexible-blade wheel and means for driving said transferring means comprise at least one device rigidly fixed to each collecting structure, engaging said underwater bed and set in motion by reaction with said bed during propulsion of said structures and means for transmitting motion from said device to said wheel and to said means for driving said transferring means.

6. A unit according to claim 3, wherein said unit includes means for measuring variations in slope of the sea bed between two zones located respectively upstream and downstream of each collecting means and means actuated by said measuring means controlling said means for positioning said extraction blades, said measuring means comprising a soft pressing pad located upstream of each collecting means.

7. A unit according to claim 3, wherein said means for positioning said extraction blades includes threshold means sensitive to a force applied to said blade tips for withdrawing said extraction blades when said force exceeds a threshold value defined by said threshold means and for restoring said extraction blades to said work position when said force is below said threhold value.

8. A unit according to claim 6, wherein each collecting means comprise means for defining a limiting position of blade withdrawal so that each extraction blade in this position constitutes a bearing member which supports the corresponding collecting structure on said underwater bed.

9. A unit according to claim 1, wherein each transferring means comprises a chute for discharging solid bodies into an intermediate storage space, said chute being pivotally mounted on the corresponding collecting structure, at least one conveyor for bringing the collected bodies into the chute and means for guiding and driving said conveyor.

10. A unit according to claim 9, wherein said conveyor is constituted by at least one conveyor belt.

11. A unit according to claim 9, wherein said conveyor consists of a flight conveyor.

12. A unit according to claim 1, wherein said unit comprises means for fixing the specific weight of each collecting structure and of said storage structure.

13. A unit according to claim 1, wherein said means for displacing said structures are coupled to an underwater traction vehicle.

14. A unit according to claim 1, wherein said means for displacing said structures are constituted by devices for carrying the storage structure which are capable of imparting motion to said storage structure by reaction on said underwater bed.

15. A modular dragging unit for collecting solid bodies on an underwater bed, said dragging unit comprising a plurality of collecting structures for individually collecting said solid bodies, said structures being applied against said underwater bed and located side by side at a front edge of said dragging unit, a storage structure for storing said bodies as they are collected, said structure being applied against said underwater bed, means for displacing said collecting and storage structures along said bed in a given direction, said means being rigidly fixed to the storage structure, a plurality of means for collecting said bodies along said given direction, each said means being rigidly fixed to one of said collecting structures, and a plurality of means for transferring said bodies as they are collected from each collecting means into said storage structure along said given direction, each said transferring means being rigidly fixed to one of said collecting structures, wherein said unit further comprises coupling means provided between each collecting structure and the storage structure, said coupling means permitting an independent relative movement of each collecting structure with respect to the storage structure and maintaining each collecting structure in a predetermined distance and orientation with respect to said underwater bed at the time of collection of said bodies whatever the position of said structure relative to said bed and whatever the variations in profile of the underwater bed, each coupling means between one of said collecting structures and the storage structure comprising at least one link-arm connected to each structure to provide at least two degrees of freedom, means for measuring variations in slope of said bed upstream of each collecting structure, means for positioning each collecting means at a predetermined level with respect to said bed, and means actuated by said measuring means controlling said means for positioning each collecting means.

* * * * *